US006856772B2

(12) United States Patent
Bessho et al.

(10) Patent No.: US 6,856,772 B2
(45) Date of Patent: Feb. 15, 2005

(54) IMAGE FORMING APPARATUS WITH TYPE-OF-TRANSFER MATERIAL CLEANING FEATURE

(75) Inventors: Yuji Bessho, Chiba (JP); Takeshi Tomizawa, Chiba (JP); Makoto Saito, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/424,825

(22) Filed: Apr. 29, 2003

(65) Prior Publication Data

US 2003/0206746 A1 Nov. 6, 2003

(30) Foreign Application Priority Data

May 2, 2002 (JP) ..... 2002-131014
Aug. 5, 2002 (JP) ..... 2002-227049
Apr. 7, 2003 (JP) ..... 2003-103295

(51) Int. Cl.[7] ..... G03G 15/00; G03G 15/16; G03G 21/00

(52) U.S. Cl. ..... 399/45; 399/71; 399/101; 399/302; 399/343

(58) Field of Search ..... 399/45, 71, 101, 399/99, 343, 346, 302, 308, 43

(56) References Cited

U.S. PATENT DOCUMENTS 4,869,955 A 9/1989 Ashcraft et al. ..... 428/327
5,395,677 A 3/1995 Harada et al. ..... 428/195.1
5,970,282 A * 10/1999 Yanagida et al. ..... 399/101
5,983,050 A 11/1999 Takekoshi et al. ..... 399/71
5,991,570 A 11/1999 Haga et al. ..... 399/114
6,032,006 A * 2/2000 Yanagida ..... 399/101
6,311,031 B1 * 10/2001 Hirano ..... 399/101
2003/0156851 A1 * 8/2003 Koh et al. ..... 399/45

FOREIGN PATENT DOCUMENTS

| | | |
|---|---|---|
| JP | 62-94332 | 4/1987 |
| JP | 1-315768 | 12/1989 |
| JP | 6-75419 | 3/1994 |
| JP | 9-212008 | 8/1997 |
| JP | 11-24506 | 1/1999 |
| JP | 11-84985 | 3/1999 |
| JP | 11-95573 | 4/1999 |
| JP | 2001-175090 | 6/2001 |
| JP | 2002-304101 | * 10/2002 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes a toner image forming portion for forming a toner image on a first image bearing member, a first transferring portion for transferring, onto a second image bearing member, the toner image on the first image bearing member, a second transferring portion for transferring, onto a transferring material, the toner image on the second image bearing member, a cleaning unit including a cleaning member abutting on the surface of the second image bearing member, and a transferring material recognizing portion for recognizing a type of the transferring material. The toner image forming portion forms a toner image for cleaning on the first image bearing member in accordance with information about a type of the transferring material that is recognized by the transferring material recognizing portion. The first transferring portion transfers, onto the second image bearing member, the toner image for cleaning on the first image bearing member, and the cleaning unit collects the toner image for cleaning on the second image bearing member.

39 Claims, 12 Drawing Sheets

IMAGE FORMING APPARATUS WITH TYPE-OF-TRANSFER MATERIAL CLEANING FEATURE

BACKGROUND OF THE INVENTION

1. Field of the Invention

The present invention relates to an image forming apparatus for transferring, onto a transferring material held on a transferring material holding member, a toner image obtained by developing over an image bearing member with a toner on the basis of electrophotographic system or an electrostatic recording system, or to an image forming apparatus for performing a primary transfer onto an intermediate transferring member and thereafter performing a secondary transfer onto a transferring material, and can be embodied in a copying machine, a laser beam printer, a FAX and so forth.

2. Related Background Art

The following are examples of an image forming apparatus such as a copying machine and a printer based on the electrophotographic system.

One example of the system is that a toner image formed on an image bearing member is electrostatically transferred onto an intermediate transferring member, and the toner image on the intermediate transferring member is further electrostatically transferred onto a transferring material. The transferring material onto which the toner image has been transferred is separated from a transferring material holding member, and thereafter the image is fixed. Then, after transferring the toner image onto the transferring material, the surface of the intermediate transferring member is cleaned off by a cleaning unit.

Another example of the system is that the toner image forming on the image bearing member is electrostatically transferred onto the transferring material held and carried by the transferring material holding member in such a way that the transferring material holding member electrostatically adsorbs the toner image. The transferring material onto which the toner image has been transferred is separated from the transferring material holding member, and thereafter the image is fixed. Then, the surface of the transferring material holding member after the transferring material has been separated from is cleaned off by the cleaning unit.

In the image forming apparatus adopting the intermediate transfer system described above, the toner carried on the intermediate transferring member is adhered to a belt by an electrostatic force (Coulomb attraction) and an intermolecular force (van der Waals force), etc.. The secondary transfer is a process of pulling toner particles away from the intermediate transferring member (intermediate transferring belt), wherein with a secondary transfer bias, an electric field is applied to a toner layer on the intermediate transferring member, thereby carrying the electrified toner onto the transferring material.

At this time, if an adhesion force to the intermediate transferring member locally rises for some reason, a secondary transferring property worsens at that local portion, and the image might be deteriorated.

A foreign matter adhered to the intermediate transferring member is removed normally by use of a cleaning unit for the intermediate transferring member. The cleaning unit may involve the use of the known cleaning unit such as a cleaning blade, a fur brush or bias roller cleaning and so on, wherein the foreign matter, if substantially equal to or larger than a toner size, can be removed.

In these cleaning units, if continuously used for a long period of time, a friction force with the intermediate transferring member increases. Therefore, in the case of utilizing, for instance, a blade-shaped cleaning unit, an undesirable phenomenon such as a burr, a chatter, etc. occurs.

A measure for this has hitherto been taken so as not to cause the image deterioration due to the adhesion of the foreign matter to the intermediate transferring member in a way that keeps a cleaning property for a long period of time by a method of, as known in Japanese Patent Application Laid-Open No. 11-95573, periodically forming a toner zone on the intermediate transferring member and supplying the toner zone to the cleaning unit without being secondarily transferred, thereby relieving a load on the cleaning portion and reducing a friction force.

Further, as known in Japanese Patent Application Laid-Open No. 2001-175090, there is taken a method of supplying the toner in order to avoid a damage to the cleaning blade. In a case where small-width sheets such as postcards, label sheets, etc. are continuously passed by, a large surface electric charge is selectively applied to a portion, having no small-width transferring material in a main scan direction, of the intermediate transferring belt, and therefore surface roughness of the intermediate transferring belt might increase upon receiving a discharge attack. At this time, since only roughness of a non-sheet passing portion of the intermediate transferring belt rises, an edge of the cleaning blade is burred at a portion corresponding to the non-sheet passing portion or locally damaged, resulting in a decline of the cleaning property. Hence, this method intends to relieve the load on the cleaning blade by forming the toner zone at only the non-sheet passing portion.

As explained above, there has hitherto been taken the measure for relieving the load on the cleaning unit by forming the toner zone on the intermediate transferring belt so that the cleaning unit can stably remove the foreign matter over the long period of time.

There might be, however, a case where a foreign matter that can not easily be removed by the cleaning unit described above is to be adhered, a secondary transfer property might worsen if unable to remove this type of foreign matter.

For example, if a user or a serviceman carelessly touches the intermediate transferring member, a smegma is adhered onto the intermediate transferring member. The smegma is a cortical secretion that can not be easily removed by the known cleaning method. In this case, a compatibility of the smegma with a toner base material, e.g., with a polyester resin is extremely high, and hence the adhesion force between the toner and the smegma extremely increases, with the result that the secondary transfer property locally worsens. Accordingly, if carelessly touching the intermediate transferring member, a local decrease in density assuming a fingerprinted shape occurs in the image.

In this respect, there is a scheme for avoiding the careless finger touch on the intermediate transferring member when the user or the serviceman replace the intermediate transferring member or an intermediate transferring member stretching unit by providing an intermediate transferring member protect member as known in, e.g., Japanese Patent Application Laid-Open No. 11-84985.

On the other hand, other than the case where the adhesive matter is artificially stuck to the belt as described above, there is a case in which the foreign matter is transferred from the transferring material when a specified type of transferring material is passed by.

According to the intermediate transfer system, even a full-color image formation involves only one transfer as a secondary transfer for transferring the toner image onto the sheet, and therefore a configuration of a transferring material conveying portion is less complicated than in other systems. Hence, it is possible to correspond to a wide range of transferring materials such as a label sheet, a postcard, an envelop, a tab sheet, an OHP sheet, etc. in addition to, of course, ordinary sheets ranging from a thin sheet (50 g/m$^2$) up to an extra-thick sheet (260 g/m$^2$).

When the thus-diversified transferring materials are passed by, these transferring materials undergo the transfer in a pressurized-state at a secondary transfer portion, so that a filler of the transferring material and a sheet powder are transferred onto the intermediate transferring member.

A large foreign matter such as the sheet powder that is on the order of several tens of microns or larger, can be collected by an intermediate transferring belt cleaner.

While on the other hand, as in the case of the filler in the transferring material, particles smaller than the toner particles might not be collectable by the cleaner. This is exemplified by, for instance, a charge inhibition agent coated over the surface of a transparency film for OHP (Over-Head Projector) (which will hereinafter be called an OHP sheet) and a glue of the envelop.

The OHP film is configured by providing, for example, a resin layer containing the charge inhibition agent on a resin base layer composed of a high-transparency PET resin, PC resin, etc. as a base material. The charge inhibition agent is contained as a filler for the purpose of improving a conveying property in the image forming apparatus by restraining an electrostatic adsorption between the OHP films and for the purpose of ensuring a preferable transferring property by adjusting a surface resistivity of the OHP film.

A measure (Japanese Patent Application Laid-Open No. 1-315768, etc.) against the OHP conveying deterioration is an adjustment of friction by making a coating layer on the surface contain a mat agent, and so on. Further, a polyethylene terephthalate film has a high surface intrinsic resistance, and hence, when trying to form the image as it is, it is required that a bias transfer potential applied to the contact transferring material be high on the occasion of transferring onto the film a toner image on the image bearing member such as a photosensitive member. Consequently, there is a case where the image deterioration occurs due to an abnormal discharge. A scheme for coping with this problem is a restraint of the surface intrinsic resistance down to a certain normal value by coating the charge inhibition agent over the film surface. This enables a charge-stuck conveying deterioration to be retrained. A multiplicity of means for adjusting the surface resistance have been proposed. A general means among those is a method of coating the charge inhibition agent over the surface of a support member. Agents exemplified as the charge inhibition agent are ion conductive agents (anionic charge inhibition agent, cationic charge inhibition agent, amphoteric charge inhibition agent, etc.), and electron conductive agents (zinc oxide, tin oxide, titanium oxide, etc.) (Japanese Patent Application Laid-Open Nos. 62-94332 and 6-75419, etc.).

Some of the charge inhibition agents given above are contained in the OHP film in the form of filling the resin layer and are coated over directly the resin film after being solved in a volatile solvent such as methyl ethyl ketone and so on.

If a surface-active agent defined as an OHP filler described above is transferred onto the intermediate transferring member, a surface energy of the intermediate transferring member decreases in a high-humidity environment. The intermediate transferring member with its surface energy decreased comes to have a decrease in toner releasing property, i.e., the toner adhesion force might increase.

On the other hand, in the case of a sheet-glued transferring material such as the envelop, the glue is eluted in the high-humidity environment and might be transferred onto the intermediate transferring member. The glue used for the envelop is an easy-to-dissolve starch glue, etc. that is frequently utilized in terms of its adaptability to the environment, and this is an easy-to-be-wettable material in the high-humidity environment.

Then, if the glue of the envelop is transferred onto the intermediate transferring member at the secondary transfer portion where the envelop is brought into contact with the intermediate transferring member, the toner adhesion force of the intermediate transferring member rises, and hence the secondary transfer property might worsen.

As explained above, when a specified transferring material is passed by, a substance causing a decrease in surface energy is transferred onto the intermediate transferring member from the transferring material, the toner adhesion force of the intermediate transferring member increases, and the secondary transfer property worsens. As a result, it might appear as the image deterioration.

On the other hand, the image forming apparatus using the transferring material holding member has, though capable of preventing a problem derived from a rise in transfer potential due to a charge-up by the charge inhibition agent used on the transparent film (OHP), a possibility of causing such a fresh problem that the charge inhibition agent is transferred onto the conveying belt from the OHP, and the image deterioration is caused by a remarkable decline of an adsorption force of the transferring material (recording material) to the conveying belt defined as a transferring material holding member. This phenomenon will hereinafter be described in detail.

FIG. 11 shows a transition of the adsorption force between the transparent film and the conveying belt when the transparent films are consecutively passed by in the image forming apparatus shown in FIG. 10. The adsorption force is, as shown in FIG. 12, obtained by pulling an A4-sized recording material P adsorbed to the conveying belt in an arrowhead direction by a spring scale and measuring a critical tensile force F when the recording material P starts sliding. It is understood from examinations by the present inventors that if the adsorption force is smaller than approximately 1 kgf, the recording material deviates from the conveying belt while the recording material is carried with the result that the image deterioration such as a color deviation, etc. occurs. It is also, however, understood that the adsorption force decreases as the transparent film is passed by and eventually becomes smaller than 1 kgf as seen in FIG. 11. The reason for this is considered such that the charge inhibition agent on the transparent film is transferred onto the conveying belt with the result that the surface resistivity of the conveying belt surface is reduced, and hence there are decreased a charge retainability on the conveying belt surface and also an electrostatic adsorption force.

Further, there is considered a case in which the charge inhibition agent is coated over only the surface or only the undersurface or both of the surfaces depending on the type of the transparent film. It is conceived that the transparent film, of which both surfaces or only the undersurface is coated with the charge inhibition agent, is easy to transfer the same agent onto the conveying belt. The transparent film, of which only the surface is coated with the charge inhibition agent, likewise brings about the same image deterioration as the above-mentioned because of the charge inhibition agent being transferred once onto, e.g., the photosensitive drum, etc. and further transferred again onto the conveying belt.

For preventing such a problem from arising, it may suffice that the charge inhibition agent adhered onto the conveying belt surface can be cleaned by the cleaning unit such as, e.g., the fur brush, etc. The cleaning unit such as the fur brush has, however, no effectiveness in the charge inhibition agent and could remove almost no charge inhibition agent.

Japanese Patent Application Laid-Open No.9-212008 discloses a configuration of changing a cleaning capability of the cleaning unit and utilizing an auxiliary cleaning unit in order to effectively remove the toner, the releasing type oil and the foreign matter such as dust, etc.. This configuration has, however, a problem in which the construction of the apparatus and the control become complicated.

As explained above, in the image forming apparatus utilizing the intermediate transferring member and the transferring material holding member, there arises such a problem that the image deterioration occurs by an influence of the transfer the charge inhibition agent and the glue from the transferring material in the case of forming the image on a specified transferring material containing the charge inhibition agent and the glue.

SUMMARY OF THE INVENTION

It is a primary object of the present invention, which was devised in view of the prior arts described above, to prevent image deterioration occurred after a specified transferring material is passed by without taking a complicated construction.

To accomplish the above object, a preferable image forming apparatus includes a toner image forming portion for forming a toner image on a first image bearing member, a first transferring portion for transferring, onto a second image bearing member, the toner image on the first image bearing member, a second transferring portion for transferring, onto a transferring material, the toner image on the second image bearing member, a cleaning unit including a cleaning member abutting on the surface of the second image bearing member, and a transferring material recognizing portion for recognizing a type of the transferring material, wherein the toner image forming portion forms a toner image for cleaning on the first image bearing member in accordance with information about a type of the transferring material that is recognized by the transferring material recognizing portion, the first transferring portion transfers, onto the second image bearing member, the toner image for cleaning on the first image bearing member, and the cleaning unit collects the toner image for cleaning on the second image bearing member.

Another preferable image forming apparatus includes a toner image forming portion for forming a toner image on an image bearing member, a transferring material holding member for holding and conveying a transferring material towards the image bearing member, a transferring portion for transferring, onto the transferring material, the toner image on the image bearing member, a cleaning unit including a cleaning member abutting on the surface of the transferring material holding member, and a transferring material recognizing portion for recognizing a type of the transferring material, wherein the toner image forming portion forms a toner image for cleaning on the image bearing member in accordance with information about a type of the transferring material that is recognized by the transferring material recognizing portion, the transferring portion transfers, directly onto the transferring material holding member, the toner image for cleaning on the image bearing member, and the cleaning unit collects the toner image for cleaning on the transferring material holding member.

BRIEF DESCRIPTION OF THE DRAWINGS

FIG. 11 is a graph representing a decline of adsorption force when a transparent sheet is passed by;

DETAILED DESCRIPTION OF THE PREFERRED EMBODIMENTS

Preferred embodiments of the present invention will hereinafter be explained in detail by way of exemplifications with reference to the accompanying drawings. Dimensions, materials, configurations and relative layouts of components described in the embodiments are not, however, such elements that the range of the present invention is limited to only those given above unless otherwise described in particular. Further, in the following discussion, the materials, the configurations, etc. of the members explained once are the same as those in the first description unless described again.

(First Embodiment)

A first embodiment of the present invention will be explained with reference to FIGS. 1 through 9.

Figure 2:
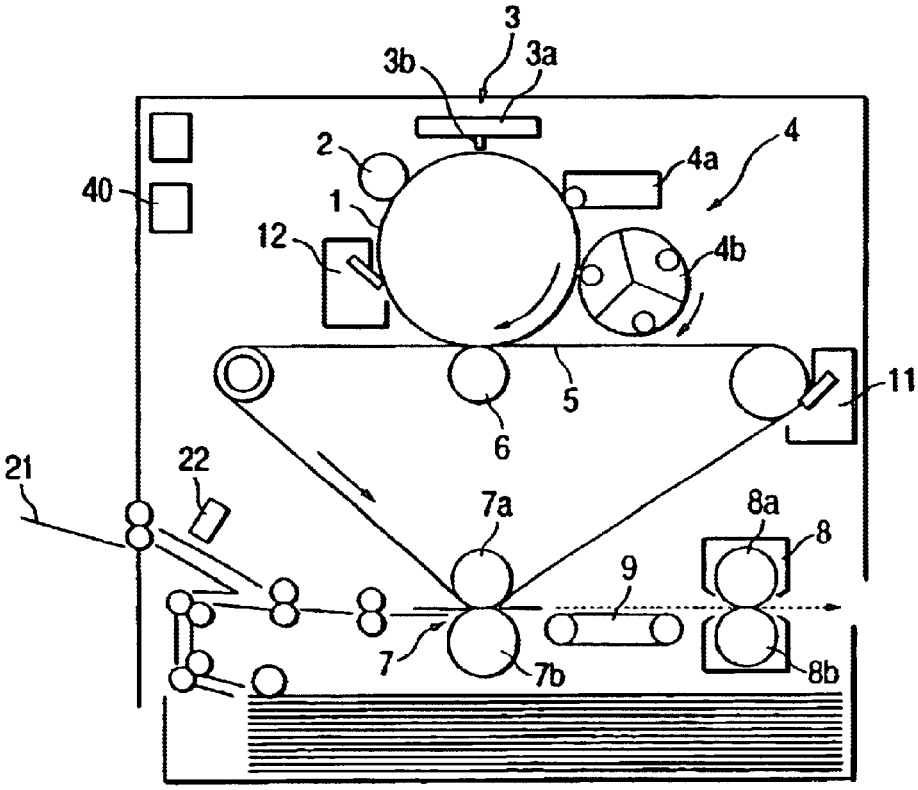
FIG. 2 is a schematic view of an image forming apparatus in an embodiment of the present invention.

To start with, an outline of construction of an electrophotographic color laser printer defined as one example of an image forming apparatus including an intermediate transferring member in the embodiment of the present invention, will be described referring to FIG. 2.

In the first embodiment, a photosensitive drum 1 has an organic photoconductor (OPC) layer formed on an outer surface of an aluminum cylinder having a diameter of 60 mm, and is rotatably supported. A photosensitive drum cleaner 12 and an electrifying roller 2 serving as a primary electrifying portion are disposed on the periphery of the photosensitive drum 1. The photosensitive drum 1 is rotationally driven by an unillustrated drive motor in an arrowhead direction illustrated therein.

The electrifying roller 2 classified as a conductive roller is made to abut on the photosensitive drum 1, and a bias is applied to the electrifying roller 2, whereby the surface of the photosensitive drum 1 is uniformly electrified in negative polarity.

A laser exposure apparatus 3 effects an exposure of the photosensitive drum 1. The laser exposure apparatus 3 undergoes ON/OFF control by a laser driver 3*a*, and a laser 3*b* performs a selective exposure on the photosensitive drum 1, thereby forming an electrostatic latent image.

A developing portion 4 for visualizing the electrostatic latent image is constructed of a fixed developing device 4*a* and a revolver developing device 4*b* accommodating developing devices for colors such as yellow, magenta and cyan.

The fixed developing device 4*a* serves to form a visible image by a black toner on the photosensitive drum 1, and a developing sleeve of a black developing device 4*a* is disposed at a minute interval (on the order of 300 $\mu$m) in a position that faces the photosensitive drum 1.

The fixed developing device 4*a* develops the electrostatic latent image formed on the photosensitive drum 1 in such a way that a toner carry mechanism within the developing device carries the black toner to the developing sleeve, the toner is applied as a thin layer over the outer periphery of the developing sleeve by use of a regulation blade brought into a press-contact with the outer periphery of the developing sleeve, an electric charge is given to the toner, and a developing bias obtained by superposing an AC bias on a DC bias is applied to the developing sleeve.

On the other hand, the three pieces of color toner developing devices, which are so held as to be detachably attachable within the rotatable revolver developing device 4*b*, rotate about an axis of rotation in a state of being held by the revolver developing device 4*b* when forming the image. For example, the yellow toner developing device stops in a position that faces the photosensitive drum 1, and the developing sleeve in the yellow toner developing device faces the photosensitive drum 1 at the minute interval (on the order of 300 $\mu$m), wherein a visible image is formed on the photosensitive drum 1. On the occasion of executing the developments of different color toner images, e.g., a cyan toner image and a magenta toner image, each of the cyan and magenta toner developing devices similarly halts in the position that facing the photosensitive drum 1 after rotationally driven, and performs the development.

Upon an end of the developing operation described above, the revolver developing device 4*b* moves away back to such a position that the developing sleeves in all colors within the revolver developing device 4*b* do not face the photosensitive drum 1, and this position is referred to as a home position.

It is possible to prevent the toners in the revolver developing device 4*b* from being incautiously being adhered to the surface of the photosensitive drum 1 and from intermingling with other color toners contained in the developing devices accommodated in other revolver developing device 4*b*. Further, the revolver developing device 4*b* is kept away back during an operation of the fixed developing device 4*a*, and hence there is no necessity of agitating the color toners when unnecessary, whereby the toners can be prevented from being unnecessarily deteriorated.

An intermediate transferring belt 5 is composed of a polyimide (PI) resin film having a thickness on the order of 100 microns, wherein carbon black is dispersed, and a resistance is adjusted so that a surface resistivity is $1\times10^{12}$ $\Omega/\square$, and a volume resistivity is $1\times108$ $\Omega\cdot$m ($1\times10^{10}$ $\Omega$cm). A peripheral length of the intermediate transferring belt is set to 565 mm, and a drive speed (a process speed) is set to 251.2 mm/sec.

A primary transferring roller 6 primarily transfers onto the intermediate transferring belt 5 a toner image visualized on the photosensitive drum 1 by the developing portion 4 in a way that applies a transfer bias thereto.

The photosensitive drum cleaner 12 cleans the residual toners on the photosensitive drum 1 which remain untransferred after the image visualized by the developing device has been transferred onto the intermediate transferring belt 5.

A secondary transferring portion 7 is constructed of a secondary transferring internal roller 7*a* and a secondary transferring external roller 7*b*. The secondary transferring portion 7 receives an application of a transfer bias, thereby secondarily transferring the toner image held on the intermediate transferring belt 5 onto a transferring material P.

A fixing device 8 fixes the toner image on the transferring material P by heating that has been conveyed by a conveying belt 9. The fixing device 8 is constructed of two pieces of rollers such as a fixing roller 8*a* for heating the transferring material P, and a pressurizing roller 8*b* for bringing the transferring material into a press-contact with the fixing roller 8*a*. The fixing roller 8*a* of these rollers is a hollow roller and has a built-in heater in its interior. The fixing roller 8*a* is rotationally driven, thereby fixing the toner image while conveying the transferring material P.

In the first embodiment, special paper such as an OHP sheet is fed from a manual sheet feed tray 21.

A transferring material judging portion 22 for judging a type of the transferring material. The transferring material judging portion 22 detects an amount of transmitted light by use of an LED light source and a pair of light receiving elements disposed on the side of the light source with a sheet path interposed therebetween and on the opposite side thereto. A transmissive transferring material such as the OHP sheet undergoes a detection of the amount of transmitted light, and, if equal to or larger than a predetermined amount of transmitted light, this transferring material is judged to be the OHP sheet.

In the first embodiment, the transferring material judging portion 22 judges that the sheet passed by is the OHP sheet, a passed-by sheet count integrating portion for integrating the numbers of passed-by sheets for every type of the specified transferring material integrates the number of passed-by OHP sheets, and, if a predetermined number of OHP sheets are passed by, a toner zone is formed on the intermediate transferring belt 5. According to the first embodiment, a toner zone formed of Bk toner is supplied onto the intermediate transferring belt 5. The toner that forms the toner zone may involve the use of toners other than black. Further, a configuration of the toner image supplied onto the intermediate transferring belt 5 is not limited to the zone-shaped toner zone described above, and there may suffice a toner image suited to supplying a sufficient toner to the intermediate transferring material cleaner 11.

A method for forming the toner zone can be, as in the case of forming the image, obtained in such a way that the developing device develops a zone-shaped latent image formed by an exposure conducted by a laser exposure apparatus and thus forms the toner zone.

A much easier forming method is, however, a method in which no exposure by the laser exposure apparatus 3 is made, and the toner zone is formed by an analog development based on only a potential difference between a surface potential of the photosensitive drum 1 and a surface potential of the developing sleeve. The following is a description of this analog development-based method.

In the case of developing the toner zone digitally by effecting the laser exposure, it is required that the drive signal be transmitted to the laser driver 3*a*. By contrast, the formation of the toner zone utilizing the analog development described above simply involves changing a setting of a high voltage such as the developing bias, etc., and it is therefore possible to minimize an increase in load on an unillustrated controller of the image forming apparatus without making the control complicated.

In the first embodiment, when normally forming the image, the potential of the photosensitive drum 1 and the potential of the developing sleeve are set as follows.

Under an environment of 23° C.·50% Rh, the control is carried out so that an AC bias obtained by superposing an AC bias of 900 Vp-p on a DC bias of −450V is applied to the electrifying roller 2, whereby the surface potential of the photosensitive drum 1 becomes −450V.

On the other hand, an AC bias obtained by superposing an AC component of 1.2 kVp-p on a DC component of −300V is applied to the developing sleeve. Note that a waveform of the AC component at this time is a blank pulse waveform, wherein a waveform formed by combining an AC waveform of 9 kHz with a blank of 4.5 kHz is applied as a developing bias. The photosensitive drum 1, when undergoing the laser exposure, comes to a light portion potential on the order of −200V at a portion where an electrostatic latent image becoming a maximum density image is formed.

Figure 3:
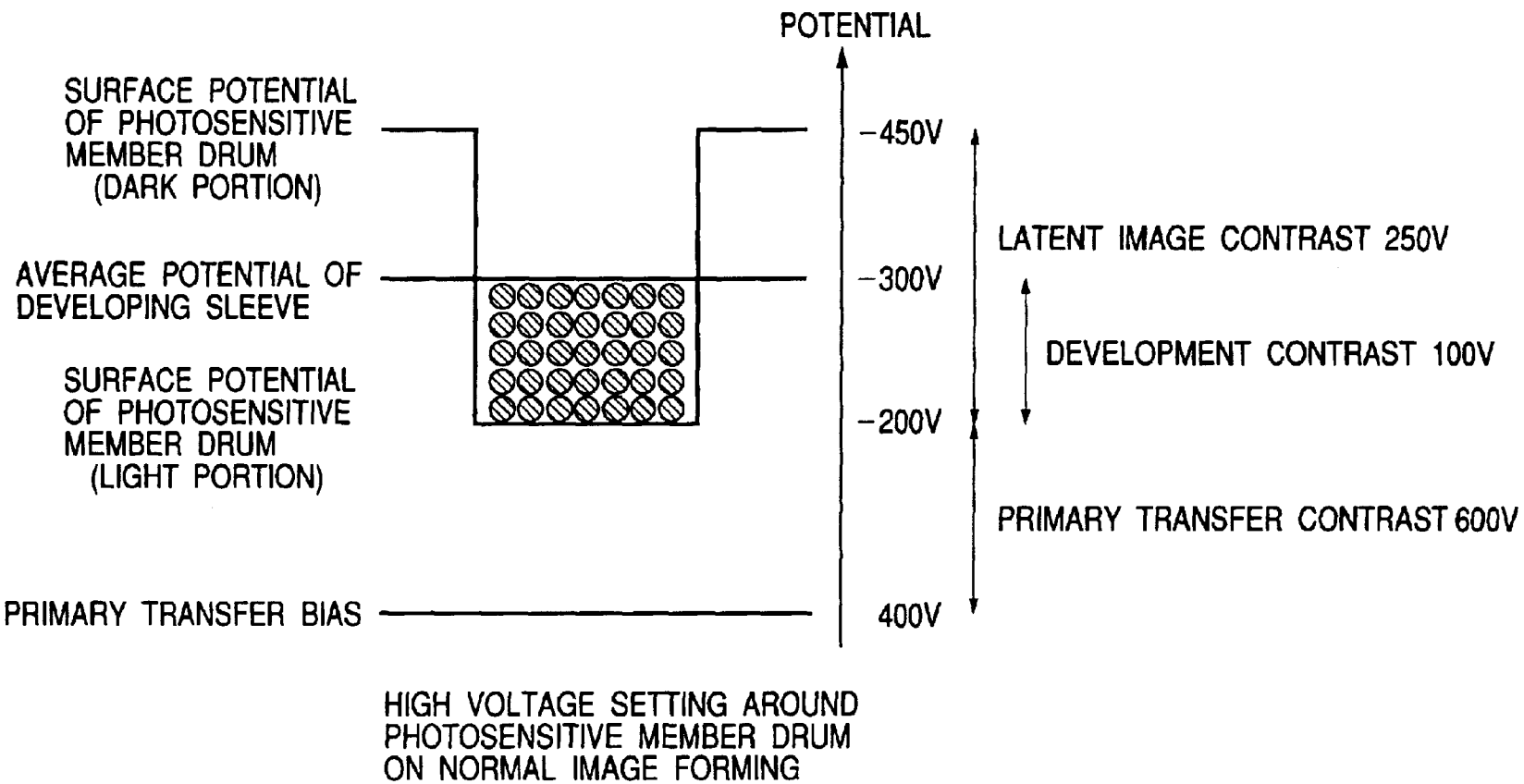
FIG. 3 is an explanatory schematic diagram showing how a variety of high voltages are set on the occasion of forming a toner image on an intermediate transferring belt when in a normal image forming operation of the image forming apparatus in the embodiment.

FIG. 3 is an explanatory schematic diagram showing settings of various high voltages on the occasion of forming the toner image on the intermediate transferring belt when in the normal image forming operation of the image forming apparatus in the first embodiment. As shown in FIG. 3, the toner electrified to the negative polarity by a potential difference between a light portion potential of −200V of the photosensitive drum and an average potential of −300V of the developing sleeve, i.e., by a development contrast, is transferred onto the light portion of the photosensitive drum 1.

Further, a potential on the order of 400V is applied as a primary transferring bias to the primary transferring roller 6, whereby a potential difference (a primary transfer contrast) between the potential of the primary transferring roller 6 and the potential of the light portion of the photosensitive drum 1 comes to 600V. Owing to this primary transfer contrast, the toner is primarily transferred onto the intermediate transferring belt 5.

What has been described so far is the high-voltage setting when in the normal image forming operation.

Given next is an explanation of the potential of the photosensitive drum and the potential of the developing sleeve when forming the toner zone.

The bias applied to the electrifying roller 2 remains unchanged. Accordingly, the surface potential of the photosensitive drum 1 remains unchanged as it is −450V that is a surface potential of a dark portion electrified by the electrifying roller 2. On the other hand, the DC component of the developing bias applied to the developing sleeve shall be a bias obtained by offsetting the potential of the dark portion of the photosensitive drum 1 with the development contrast of the maximum density portion when in the normal image formation. According to the first embodiment, since the development contrast when in the normal image formation is on the order of 100V, the DC component of the developing bias is to be −550V.

Figure 4:
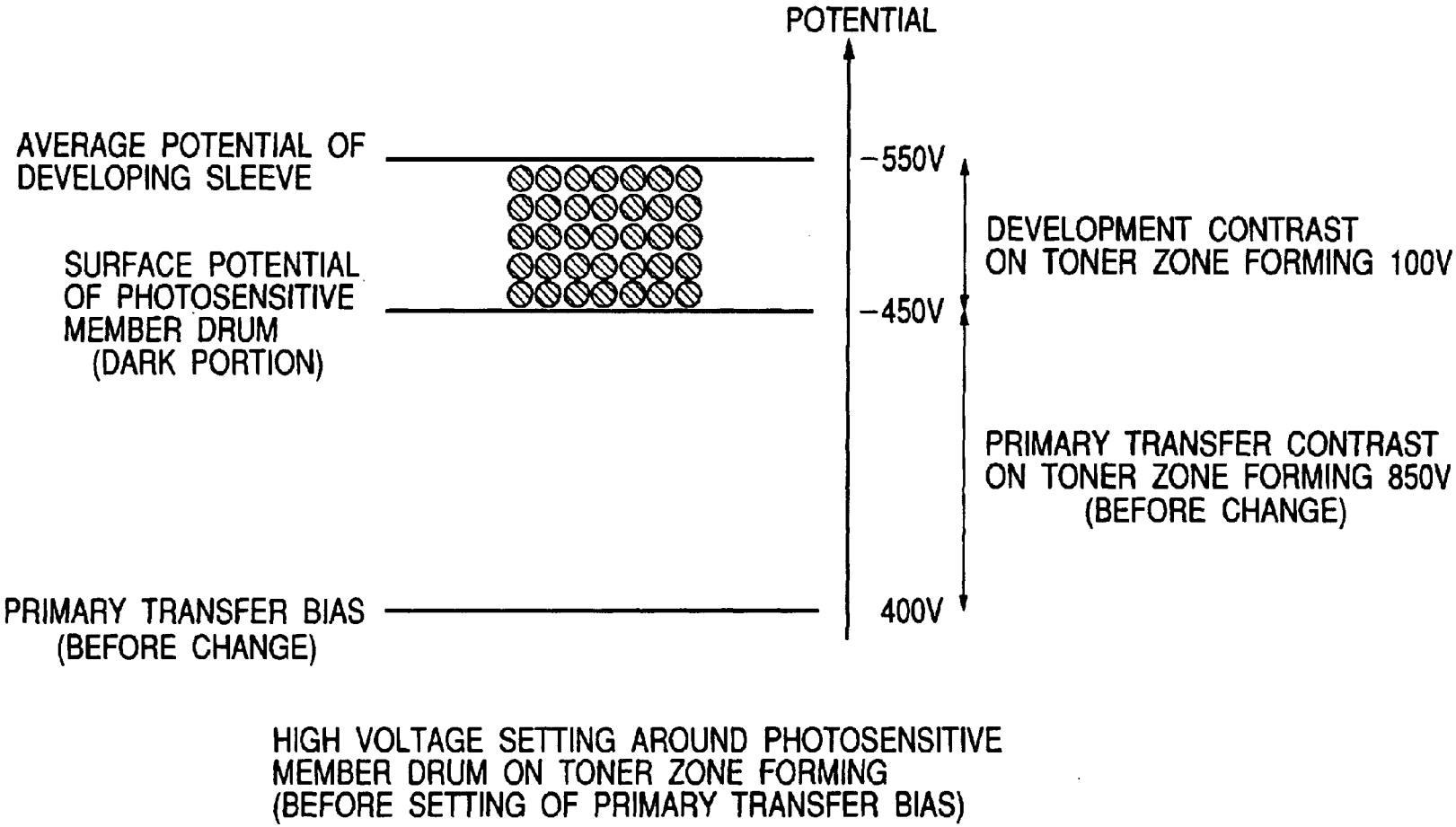
FIG. 4 is an explanatory schematic diagram showing how the variety of high voltages are set on the occasion of forming the toner image on the intermediate transferring belt when forming a toner zone in the image forming apparatus in the embodiment.

FIG. 4 is an explanatory schematic diagram showing settings of various high voltages on the occasion of forming the toner image on the intermediate transferring belt when forming the toner zone in the image forming apparatus in the first embodiment. As shown in FIG. 4, the development contrast when forming the toner zone is 100V, the same toner amount as the toner amount (a transferred-onto-the-drum toner amount) for actualizing the maximum density when in the normal image formation can be analogously developed on the photosensitive drum 1 uniformly in a thrust direction on the photosensitive drum 1. The toner zone is formed on the drum by the process described above.

Next, the toner zone formed on the photosensitive drum 1 is transferred onto the intermediate transferring belt 5. At this time, the toner zone is transferred by performing the primary transfer in the same way as the normal image formation is done. When the photosensitive drum potential and the developing bias are set as described above, however, according to the first embodiment, the primary transfer contrast becomes 850V as shown in FIG. 4, which is larger than the primary transfer contrast of 600V when in the normal image formation.

Figure 5:
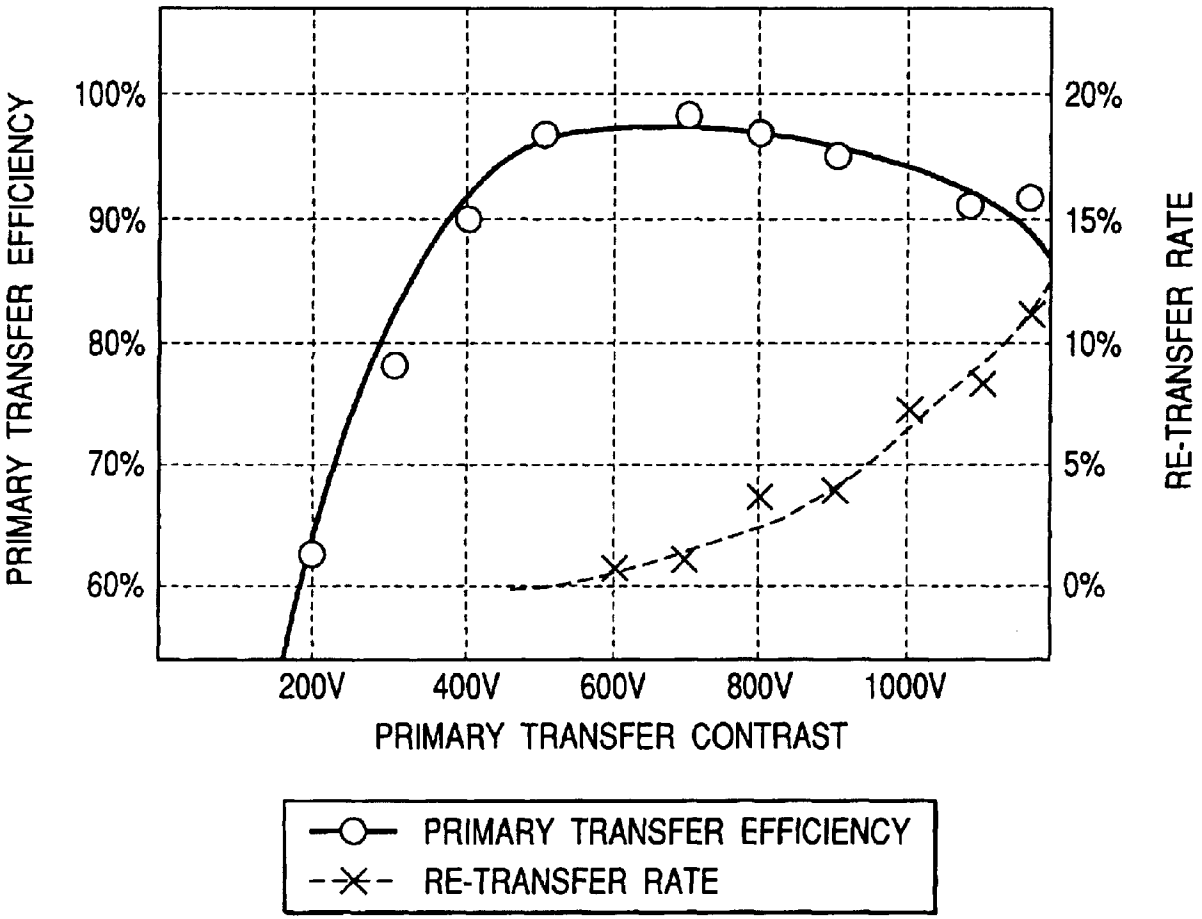
FIG. 5 is a graph showing a relationship between a primary transfer contrast, a primary transfer efficiency and a re-transfer rate.

FIG. 5 is a graph showing a relationship between the primary transfer contrast, a primary transfer efficiency and a re-transfer rate. As shown in FIG. 5, if the primary transfer contrast as too large as 850V is applied, the transferring efficiency of the toner zone decreases, and besides it follows that even the re-transfer rate rises. Therefore, there increases the toner consumed with a futility in the toners supplied for the toner zone, and this is undesirable in terms of a running cost.

The reason for this is that the contrast voltage of 600V with respect to the potential of the light portion is given as the primary transfer contrast when in the normal image formation, while the contrast potential with respect to the potential of the dark portion must be given when forming the toner zone, and the primary transfer contrast is applied extra by the potential difference between the potential of the light portion and the potential of the dark portion, i.e., by a latent image contrast of 250V.

Accordingly, for primarily transferring the toner zone properly on the intermediate transferring belt 5, the primary transferring bias must be set to a bias obtained by subtracting the latent image contrast voltage of 250V from the primary transferring bias of 400V when in the normal image formation so as to become 600V as the primary transfer contrast when in the normal image formation.

Figure 6:
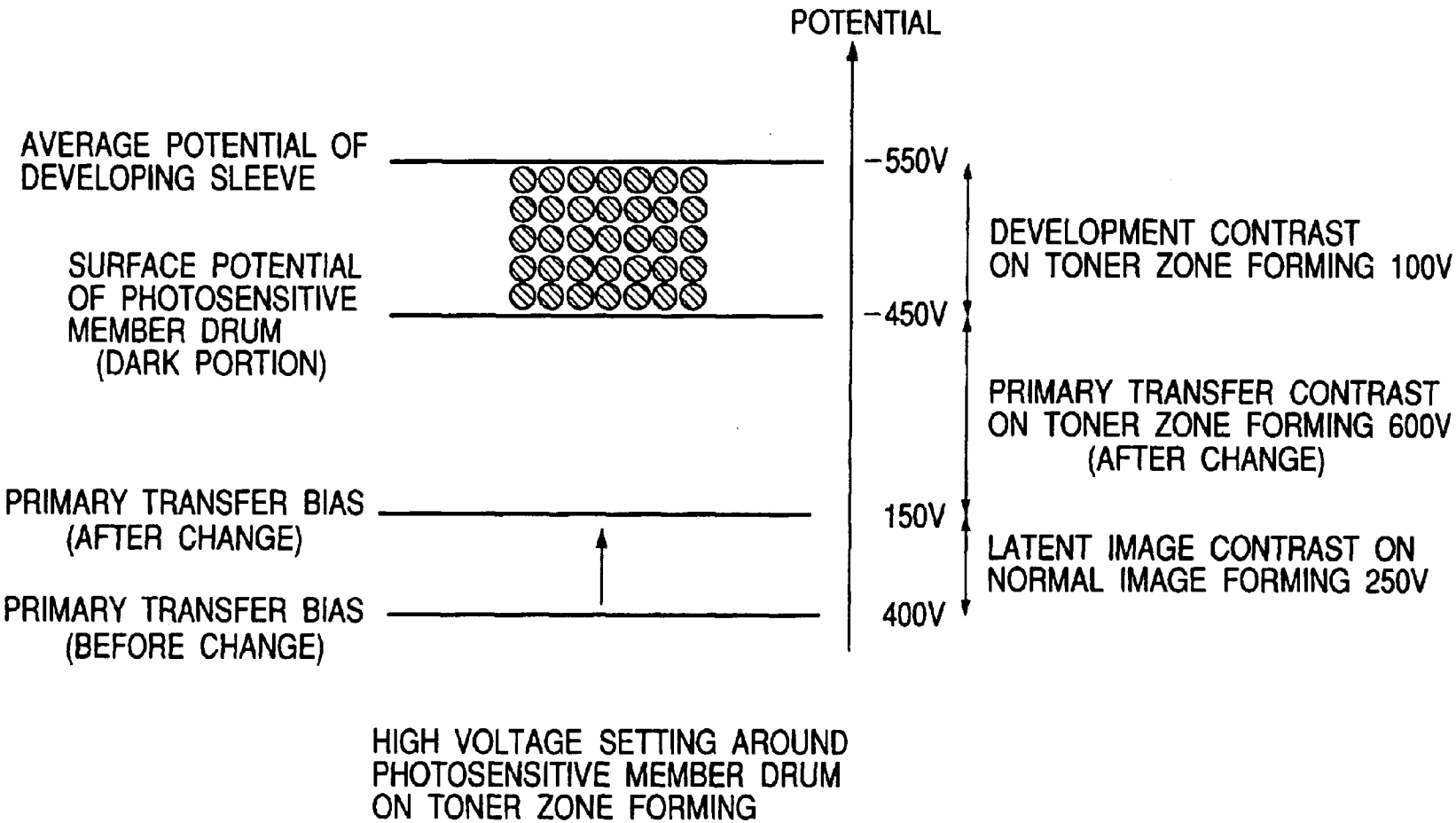
FIG. 6 is an explanatory schematic diagram showing how the variety of high voltages are set after changing the primary transfer bias on the occasion of forming the toner image on the intermediate transferring belt when forming the toner zone.

FIG. 6 is an explanatory schematic diagram showing various high-voltage settings after changing the primary transferring bias on the occasion of forming the toner image on the intermediate transferring belt when forming the toner zone. In the first embodiment, the primary transferring bias is, as shown in FIG. 6, set to 150V.

As discussed above, the toner zone can be formed on the intermediate transferring belt 5 by setting the high voltages applied to the electrifying roller 2, the developing sleeve and the primary transferring roller 6.

The thus-formed toner zone is transferred onto the intermediate transferring belt 5 after the OHP sheet has passed by, and has a function of eliminating particles of a charge inhibition agent, etc. of the OHP sheet that is adhered onto the intermediate transferring belt.

The toner zone on the intermediate transferring belt 5 is carried up to a secondary transferring portion but does not undergo a secondary transfer and is further carried up to the intermediate transferring cleaning blade 11. On this occasion, the secondary transferring external roller 7*b* in FIG. 2 is moved away from the intermediate transferring belt 5 by an unillustrated separating-and-abutting portion, whereby the toner zone on the intermediate transferring belt 5 is not disturbed on the secondary transferring portion.

Note that the toner zone forming operation described above is conducted under the control of a control unit 40.

Figure 7:
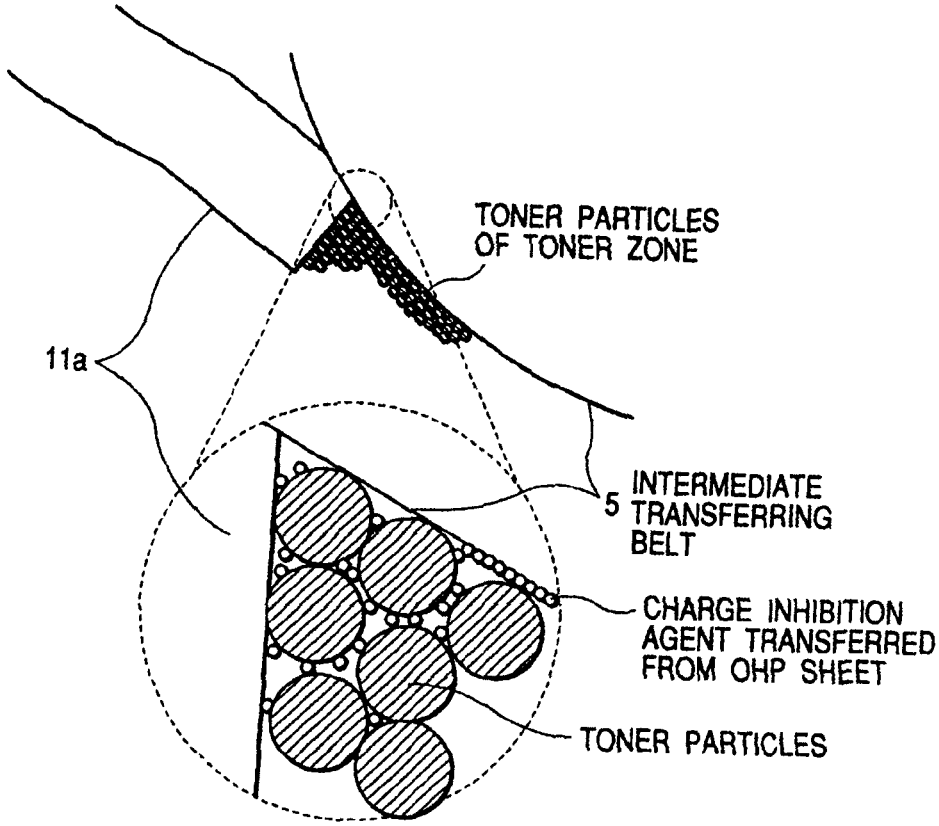
FIG. 7 is an explanatory schematic diagram showing how a charge inhibition agent adhered onto the intermediate transferring member is removed by use of the toner zone.

FIG. 7 is an explanatory schematic diagram showing how the charge inhibition agent adhered onto the intermediate transferring material is removed off. As shown in FIG. 7, the toner zone carried up to the intermediate transferring belt cleaner 11 is further carried to a portion where the cleaning blade 11*a* of the intermediate transferring belt cleaner 11 is kept in the press-contact with the intermediate transferring belt 5 and is scraped off by the cleaning blade 11*a*.

At this time, the toners concentrate on an edge portion of the cleaning blade 11*a,* and hence the toner particles receives such a shearing stress as to be pulled back toward an upstream carry direction by the blade edge. Then, the charge inhibition agent, which is adhered to the surface of the intermediate transferring belt 5, i.e., adhered to the lower layer of the toner zone and transferred to the intermediate transferring belt 5 from the OHP sheet, is scraped off and is stuck to about the toner particles. The charge inhibition agent that has been thus adhered to the toner particles is collected together with the toner particles by the intermediate transferring belt cleaner 11.

The toner in the image forming apparatus according to the first embodiment involves the use of a polymeric toner generated by a suspension polymerization method, and is classified as a spherical toner having a core/shell structure in which a core is composed of wax, and shell is composed of a thermosetting polyethylene resin serving as a polar resin.

In the case of using the spherical polymeric toner described above, even when carried to the edge portion of the cleaning blade, the toner being spherical, the toner particles are hard to stack with each other with result that the toner immediately drops down from the press-contact portion, and the scrape-off effect of the charge inhibition agent by the toner decreases.

The polymeric toner is, as compared with toners such as a pulverized toner manufactured by other methods, extremely sharp in distribution of a toner particle size, and is capable of making compatible a high blocking resistive property and a high-temperature offset resistive property by containing an oil. Therefore, the polymeric toner is indispensable for the image forming apparatus capable of providing a high-quality image.

According to the first embodiment, the toner zone using the toner such as the polymeric toner exhibiting a high spherical degree is capable of more surely removing the transferred charge inhibition agent by supplying the toner having the same transferred amount as on the maximum density portion when in the normal image formation as described above.

Further, according to the first embodiment, a thrust width of the toner zone is 305 mm, and a peripheral direction length is 60 mm.

The thrust width of the toner zone is a width of a coat area of the developing sleeve, i.e., an entire width of a possible-of-developing area. In the image forming apparatus in the first embodiment, a maximum width of the possible-of-passing transferring material is a lateral width of A3 long size, i.e., 12 inches (304.8 mm), and the toner zone covers a wider range than the maximum sheet-passing width.

This intends to clean the charge inhibition agent by use of the toner zone also for the OHP sheets of all sheet sizes having a possibility of being passed by.

The analogous development of the toner zone makes it feasible to supply the intermediate transferring belt with the toner zone having the wider range than the maximum sheet-passing width enabling the sheet to be passed by without being restricted by a maximum exposure width of the exposure apparatus, and it is possible to surely remove the transferred change preventing agent for the OHP sheets of all sizes.

Figure 1:
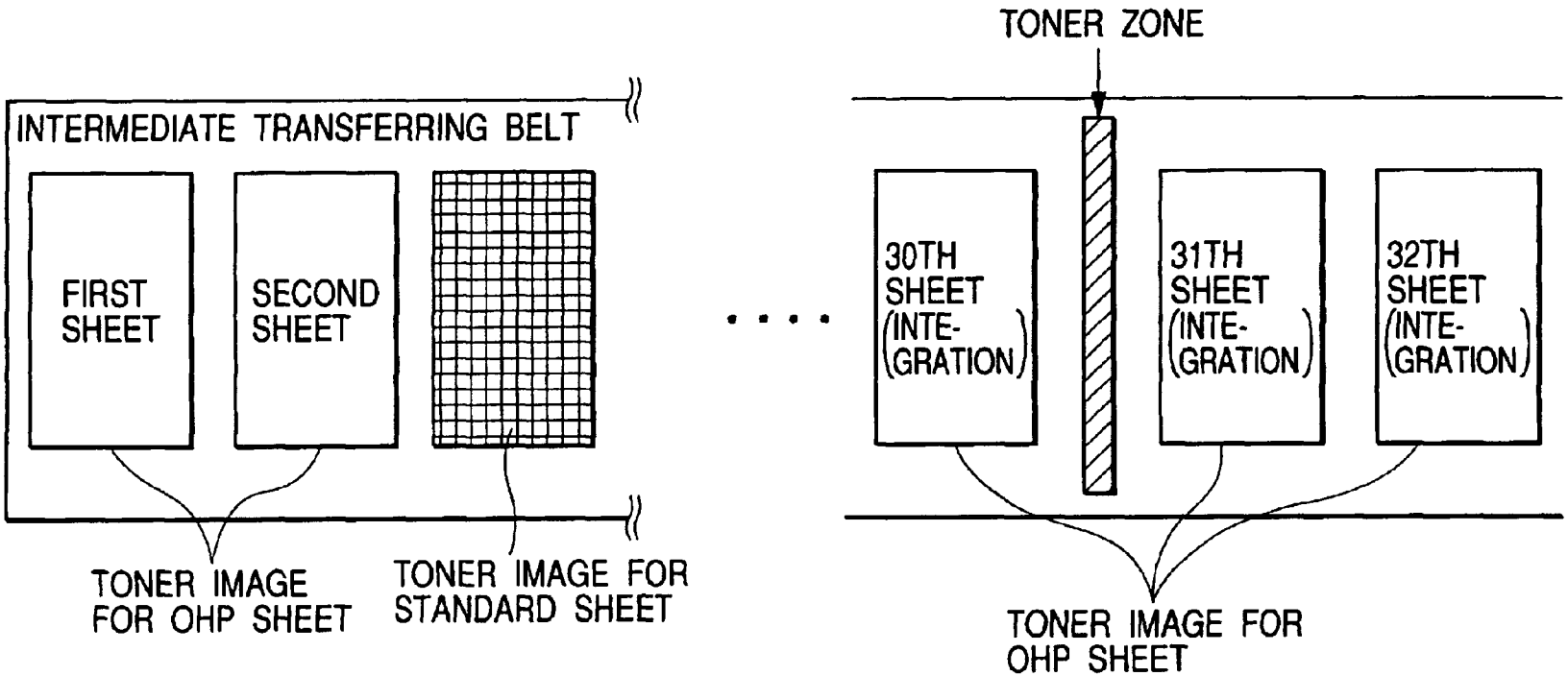
FIG. 1 is an explanatory diagram showing a timing for forming a toner zone according to the present invention.

Next, a timing for forming the toner zone will be explained. The toner zone described above in the first embodiment is, as shown in FIG. 1, formed each time the OHP sheets counted 30 by integration are passed by, and the charge inhibition agent on the intermediate transferring belt 5 is cleaned off. Referring to FIG. 1, the third sheet from the left side shows how an image to be transferred onto a standard sheet is formed in mixture. According to the present invention, the number of image forming sheets with respect to the OHP sheets is integrated also in the case of forming the image in mixture of the standard sheet and the OHP sheet.

This is because transfer deterioration occurs depending on an amount of charge inhibition agent transferred onto the intermediate transferring belt 5 from the OHP sheet.

In the image forming apparatus according to the first embodiment, an A4-sized OHP sheet [TypeA] made by Canon Inc. is vertically passed by (A4R feed) under an environment of 30° C.·80% Rh, there is measured a pure contact angle made by an OHP sheet passing portion and a non-sheet passing portion on the surface of the intermediate transferring belt.

Figure 8:
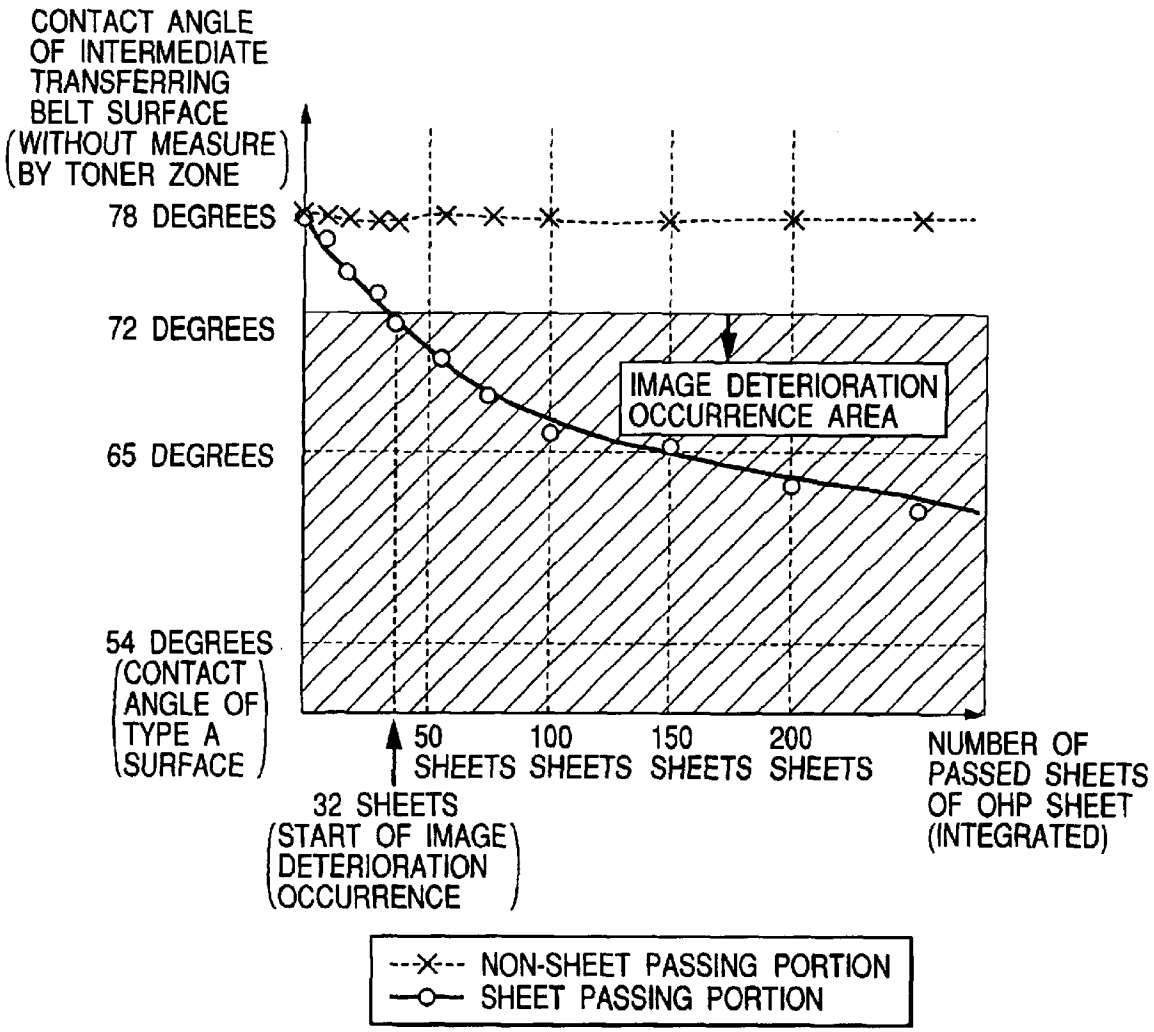
FIG. 8 is a graph showing a relationship between an integrated number of passed OHP sheets and a contact angle on the intermediate transferring belt at that time.

FIG. 8 is a graph showing a relationship between the integrated number of passed OHP sheets and a contact angle on the intermediate transferring belt at that time. Note that the pure contact angle is measured under the environment of 23° C.·50% Rh by use of a CA-S roll material contact angle meter made by Kyowa Interface Science Co., Ltd..

As shown in FIG. 8, the contact angle shows absolutely no change from an initial angle of 78 degrees in the non-sheet passing portion. While on the other hand, in the passing portion, the contact angle decreases each time the OHP sheet is passed by and becomes approximate to the contact angle of the OHP sheet itself.

Further, when an A3-sized image is formed after vertically feeding the OHP sheet, the density decreases at the portion where the OHP sheet is passed by, and the image deterioration occurs. The image deterioration occurs from at a stage wherein 32 OHP sheets have just been passed by. This is, it may be considered, derived from a worsened secondary transferring property due to such a factor that an amount of a surface-active agent transferred from the OHP sheet increases because of effecting no cleaning by the toner zone, there is decreased a surface energy of the passing portion of the intermediate transferring belt 5, and a toner adsorption force rises.

In the first embodiment, if there is inserted a sequence of forming the toner zone described above each time 30 OHP sheets are passed by, the image deterioration does not occur.

Figure 9:
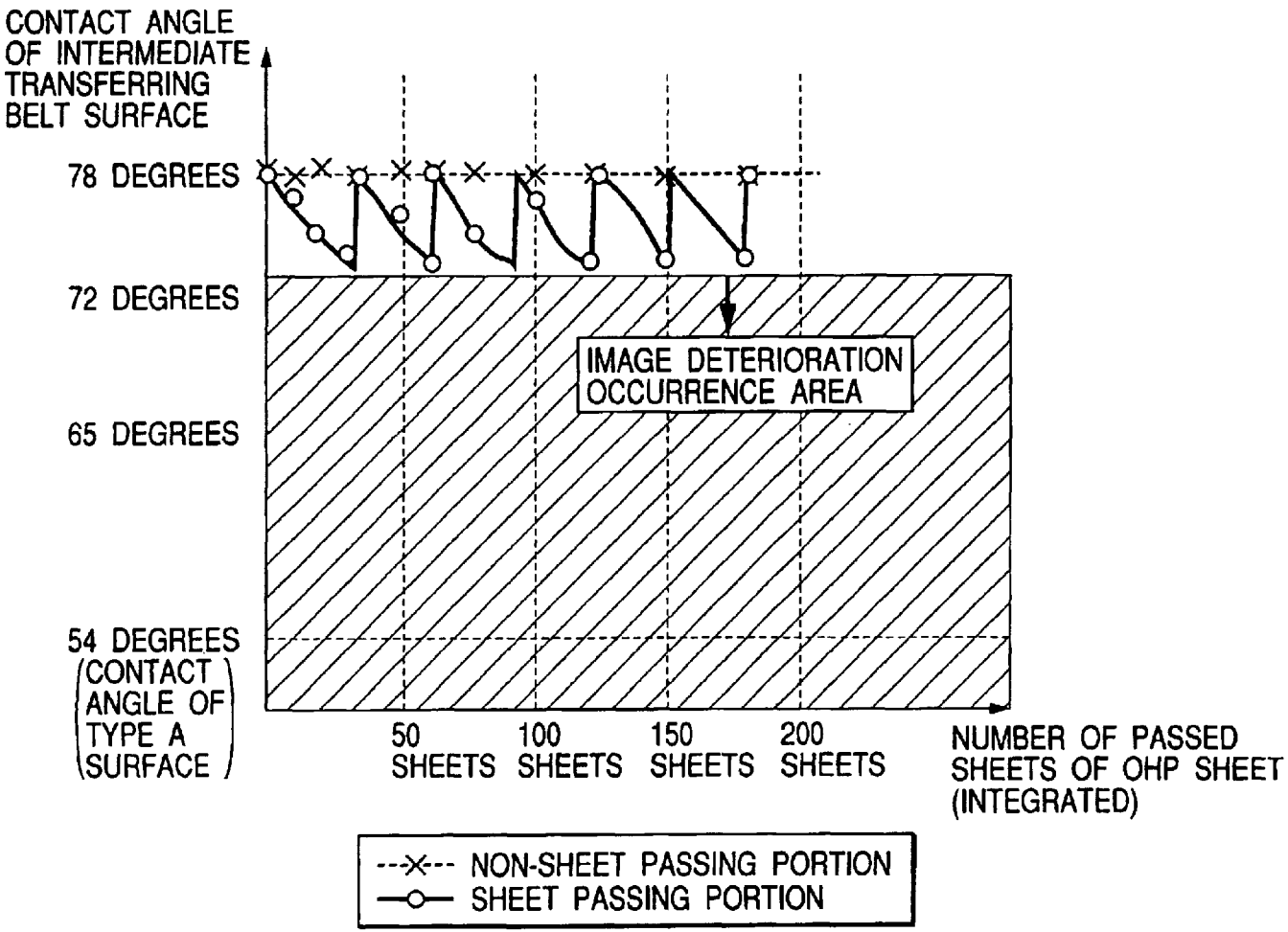
FIG. 9 is a graph showing a relationship between the integrated number of passed OHP sheets and the contact angle on the intermediate transferring belt thereat when adopting a toner zone forming sequence.

FIG. 9 is a graph showing a relationship between the integrated number of passed OHP sheets when adopting the sequence of forming the toner zone and the contact angle on the intermediate transferring belt at that time. As shown in FIG. 9, the toner zone is formed each time a predetermined number of OHP sheets are passed by, thereby cleaning the surface-active agent transferred onto the intermediate transferring belt 5 and getting a recovery of the surface energy of the intermediate transferring belt 5.

Thus, a counter (a passed sheet number integrating portion) for counting by integration what number of OHP sheets are passed by, is provided, and the control is performed so as to form the toner zone for every given number of sheets. With this control, as compared with the case of forming the toner zone each time the OHP sheets are passed by, a consumption amount of the toner consumed other than forming the image can be restrained low, and a rise in the running cost can be also restrained.

Note that the type of the transferring material to be integrated is not limited to one single type, and the number of passed sheets of plural types of transferring materials may be integrated corresponding to the transferring material for use. Further, a down-time of the image forming apparatus is reduced while restraining the occurrence of the image deterioration by setting the timing (the integrated number of sheets) for forming the toner zone for every specified type of transferring material, whereby the rise in the running cost can be restrained.

As obvious from the discussion made above, the occurrence of the image deterioration can be restrained owing to the surface-active agent transferred onto the intermediate transferring belt from the OHP sheet by inserting the sequence of forming the toner zone corresponding to the integrated number of sheets and collecting the toner zone by the intermediate transferring belt cleaner 11 on the occasion of letting the OHP sheets pass by.

Note that the first embodiment has exemplified the case of forming the toner zone for every thirty OHP sheets, however, this number of sheets is a value that can be properly changed corresponding to the construction of the apparatus and the type of the transferring material.

(Second Embodiment)

In the image forming apparatus according to the first embodiment, on the occasion of letting an envelope pass by, similarly the toner zone is formed on the intermediate transferring belt 5, and the surface of the intermediate transferring belt 5 is cleaned off.

What is used as the envelop is Schneidersohne No. 15269, and the effect of the present invention is confirmed by letting the envelope pass by in a B5R feeding way. When the envelope described above is passed by in the image forming apparatus in FIG. 2, a glue adhesion spreads over the intermediate transferring belt 5, and transfer deterioration occurs at the passing portion from the 56th passed envelop onward.

A known envelope detecting portion disclosed in, e.g., Japanese Patent Application Laid-Open No.11-24506 is used as a sheet type detecting portion (a transferring material judging portion) for detecting that the transferring material is the envelope. Namely, in the manual sheet feed tray in FIG. 2, a sheet width is detected, a sheet pressure is detected at a sheet feed roller for supplying the envelope to a transferring material conveying path in the apparatus, and a sheet thickness detected is compared with a preset thickness of the envelope, thereby judging whether the transferring material is the envelope or not.

According to a second embodiment, the toner zone is formed on the intermediate transferring belt 5 for every fifty envelopes totaled in the same high-voltage setting as in the first embodiment, thereby supplying the toner to a cleaning abut portion. Then, the intermediate transferring belt 5 can be cleaned off by utilizing the cleaning effect by this toner, and the image deterioration can be avoided.

Note that the second embodiment has exemplified the case of forming the toner zone for every fifth envelopes, however, this number of envelopes is a value that can be properly changed corresponding to the construction of the apparatus and the type of the transferring material.

Moreover, other than the method of making the apparatus automatically judge by use of the sheet pressure detecting portion, etc., what can be used as a means for judging the type of the transferring material is a method by which a user utilizing the image forming apparatus inputs a type of the transferring material for use from an input portion 3 provided on the apparatus, and the type of the transferring material is judged based on information about the type of the transferring material which obtained by this input portion.

Note that the first and second embodiments discussed above have exemplified the mode in which the toner zone is formed in the case of the specified transferring material such as the OHP sheet, the envelop, etc. but is not formed in the case of the transferring materials other than those given above. Also when forming the image on a normal transferring material, however, the toner zone is formed under predetermined conditions (a formation frequency, an amount of toner for forming the toner zone, etc.), and these toner zone forming conditions may be changed when forming the image on the specified transferring material such as the OHP sheet, the envelop, etc. Namely, the toner zone formation frequency may be increased.

For example, when forming the image on the normal transferring material, the toner zone is formed for every 200 sheets for the purpose of ensuring a lubricating property of the cleaning blade, and so on. The toner zone is formed for every 30 sheets for the purpose of removing the charge inhibition agent in the case of the OHP sheet, and is formed for every 50 sheets for the purpose of removing the glue in the case of the envelope. In this way, the toner zone formation frequency is changed corresponding to the type of the transferring material.

(Third Embodiment)

One embodiment of the image forming apparatus according to the present invention will be discussed with reference to FIG. 10. In a third embodiment, a color image forming apparatus using a transferring material holding member will be explained.

According to the third embodiment, in the image forming apparatus, image forming portions Pa, Pb, Pc and Pd are disposed within an apparatus body 110, a recording material conveying portion (a transferring material holding member) constructed of a conveying belt 108 wound round on a drive roller 111 and driven rollers 112, 113, is provided under those image forming portions Pa through Pd, and the conveying belt 108 is rotated in an arrowhead direction at a speed of 100 mm/sec. In the third embodiment, the conveying belt 108 involves the use of an endless sheet composed of a dielectric polycarbonate resin film.

The material used for the conveying belt 108 may involve the use of, in addition to those given above, what the polycarbonate resin is denatured with a silicon resin and what conductive particles such as carbon are dispersed with its volume resistance set to, e.g., $10^{12}$ through $10^{15}$ Ω·cm, and these materials are more preferable. Further, there can be also used a polyurethane resin, a polyester resin, a nylon resin, polyvinylidene fluoride (PVdF) resin and so on.

In the third embodiment, the conveying belt 108 is 150 μm in thickness and 334 mm in width. There is provided an oscillation mechanism for driving the conveying belt 108 always in the vicinity of the center in the widthwise direction of the rollers 111, 112, 113 so as not to cause such a problem that the conveying belt 108, when rotated, comes off the drive roller 111 and the driven rollers 112, 113 because of its being biased to one side in the widthwise direction right-angled to the advancing direction thereof.

Figure 10:
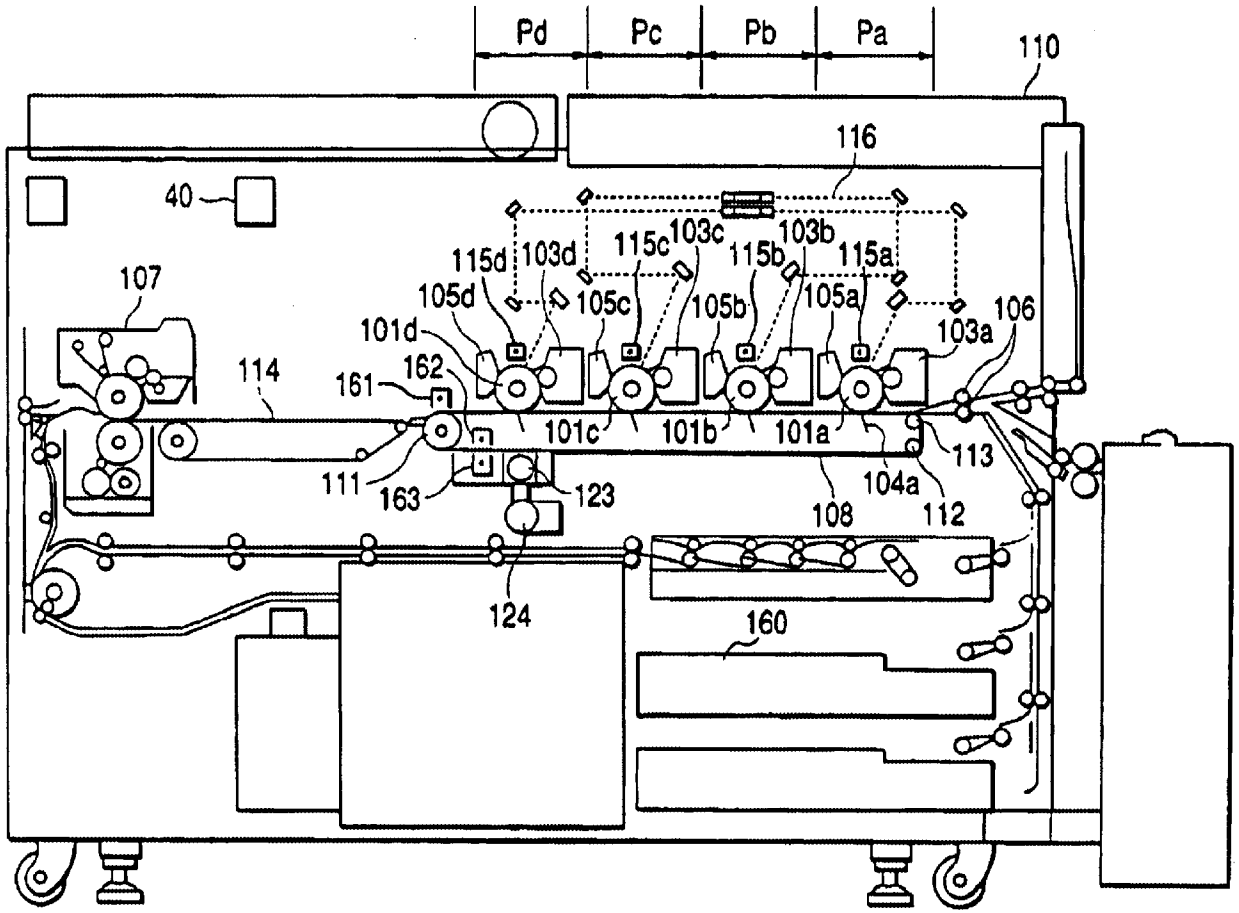
FIG. 10 is a schematic view of another image forming apparatus of the present invention.
Figure 11:
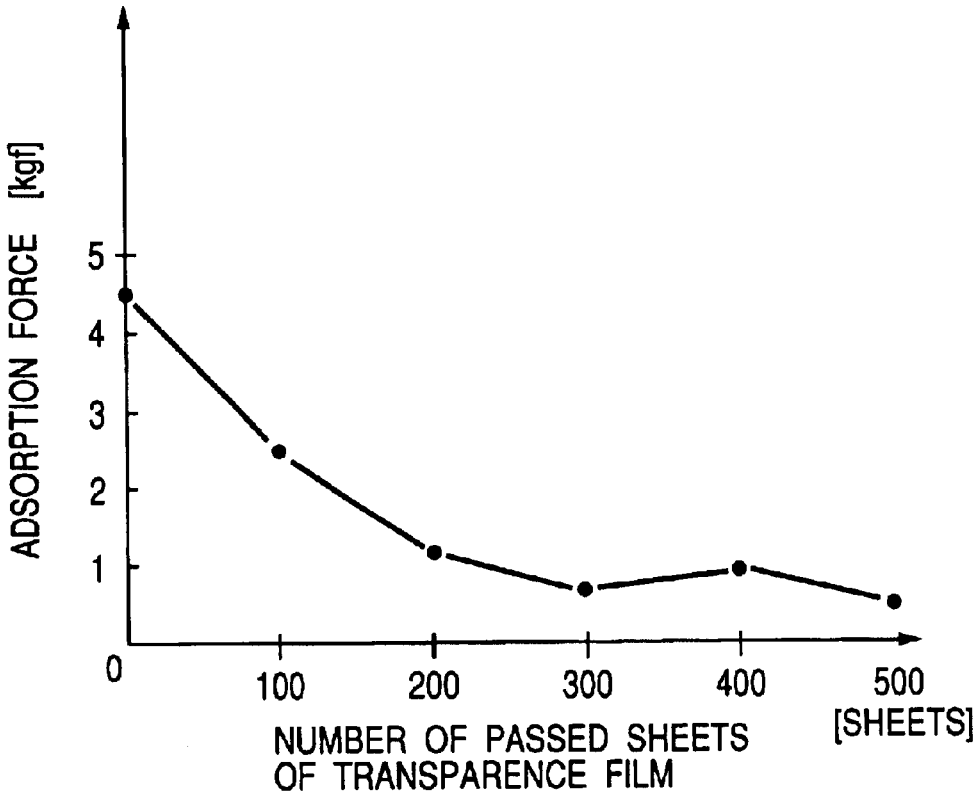
Figure 12:
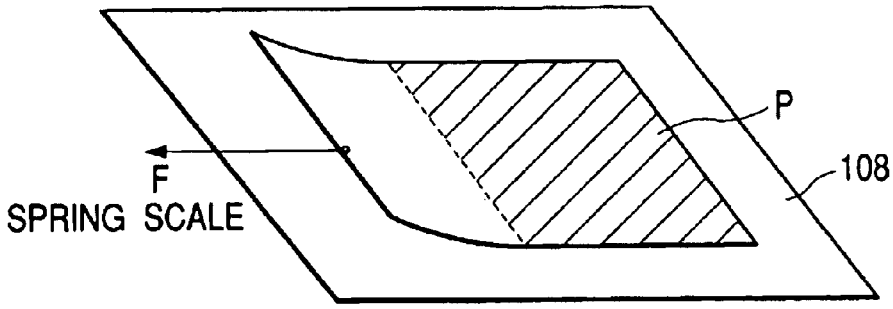
FIG. 12 is a diagram showing an adsorption force measuring method.

A registration roller 106 is disposed on the right side in FIG. 10. The image forming portions Pa, Pb, Pc and Pd disposed above the conveying belt 108 have a photosensitive drums 101*a*, 101*b*, 101*c* and 101*d*. electrifiers 115*a*, 115*b*, 115*c*, 115*d* are provided on upper sides of the photosensitive drums 101*a*, 101*b*, 101*c*, 101*d*, and developing devices 103*a*, 103*b*, 103*c*, 103*d* are provided on the right sides thereof.

Further, one common laser beam scanner 116 is disposed above the photosensitive drums 101*a*, 101*b*, 101*c*, 101*d*. The laser beam scanner 116 is constructed of a semiconductor laser, a polygon mirror, an fθ lens, etc.. The laser beam scanner 116 is structured to receive an input of electric digital image signals and to expose the photosensitive drums 101*a* through 101*d* to laser beams modulated corresponding to these signals in a way that scans in directions of generatrices of the photosensitive drums 101*a*, 101*b*, 101*c*, 101*d* between the electrifiers 115*a*, 115*b*, 115*c*, 115*d* and the developing devices 103*a*, 103*b*, 103*c*, 103*d*.

When an image formation start signal is inputted to the image forming apparatus, the photosensitive drum 101*a* starts rotating in the arrowhead direction and is, after being uniformly electrified by the electrifier 115*a*, exposed to the laser beam emitted by the laser beam scanner 116 and modulated by the image signal corresponding to the yellow component of an original image, whereby a latent image of the yellow component is formed on the photosensitive drum 101*a*. The latent image is supplied with a yellow toner and developed by the developing device 103*a* and is visualized as a yellow toner image on the photosensitive drum 101*a*.

On the other hand, the recording material(paper) is picked up by an unillustrated pickup roller from within a recording material cassette 160 and fed to the registration roller 106. The recording material is temporarily halted by a registration roller 106 and thereafter supplied, from the registration roller 106, onto the conveying belt 108 having already started rotating in a way that takes a timing with the yellow toner image formed on the photosensitive drum 101*a*. The recording material supplied into the conveying belt 108 is electrostatically absorbed thereto and carried while being held. Then, the recording material undergoes transfer electrification by an electrifying member 104*a* from underside of the conveying belt 108 at a transferring portion where the transfer electrifying member 104*a* of the image forming portion Pa is disposed, thereby transferring the yellow toner image on the photosensitive drum 101*a*.

The same image forming process is executed in each of the image forming portions Pb, Pc and Pd for magenta, cyan and black, thereby obtaining a color image formed by superposing and transferring, on to the recording material, the yellow toner image, a magenta toner image, a cyan toner image and a black toner image in this sequence from under.

The recording material with the toner image transfer finished is separated from the conveying belt 108 while undergoing AC de-electrification by a separation electrifier 161 substantially just above the roller 111 at the left end portion of the conveying belt 108, and is fed to a fixing device 107 via a pre-fixation conveying portion 114. In the fixing device 107, the toner image is heated, pressurized and thus fixed by use of a pair of rollers. Then, the toner image receives intermingling of colors and is fixed onto the recording material, thus obtaining the full-color permanent image.

The residual toners on the respective photosensitive drums 101*a*, 101*b*, 101*c*, 101*d* with the transfer finished are removed by cleaning devices 105*a*, 105*b*, 105*c*, 105*d*, and each stand by for the next image formation to be conducted subsequently.

With the end of fixing the toner image described above, the image formation terminates as it is in the case of a one-sided copy, and the sheet is discharged outside a copying apparatus body 110.

An internal de-electrifier 162 and an external de-electrifier 163 are provided with the conveying belt 108 interposed therebetween in a lower trajectory position anterior to the downstream end of the conveying belt 108, whereby the charges electrified when transferred are removed. The conveying belt 108 from which the charges electrified are removed, are next purged of the toners and dusts adhered onto the conveying belt 108 by the cleaning unit.

According to the third embodiment, a fur brush 123 is used as the toner cleaning unit. The fur brush 123 is provided more downstream than the de-electrifiers 162, 163 in the advancing direction of the conveying belt 108. The fur brush 123 cleans the surface of the conveying belt 108, thereby removing the toners and the dusts adhered onto the surface of the conveying belt 108. The toners, etc. scraped off by the fur brush 123 are collected by a collecting device 124 provided with a suction fan.

A characteristic of the present invention is herein that the formation of the image on the specified recording material (e.g., the OHP sheet) is finished, and the toner image is directly formed as uniformly as possible on the substantially entire image forming area on the conveying belt after the specified recording material has been separated therefrom. Namely, the uniform toner image formed on the photosensitive drum is transferred corresponding to the area (having held so far the OHP sheet) of the conveying belt from which the image-transferred OHP sheet. The toner covering over the charge inhibition agent already adhered onto the conveying belt adsorbs the charge inhibition agent. The charge inhibition agent is cleaned together with the toner by the fur brush 123, and hence no charge inhibition agent is left on the conveying belt after the cleaning unit has passed by. It is therefore possible to prevent the image deterioration from occurring due to the existence of the charge inhibition agent. Further, the use of this means neither requires adding extra members, etc. only for removing the charge inhibition agent nor leads to a considerable rise in cost. It is desirable that the toner image formed directly on the conveying belt covers over the entire image forming area as much as possible, and a half-tone image may be formed of the single-color toner, for example, the yellow toner. Moreover, for uniformizing an amount of toner consumption for every color, the image may be formed directly on the conveying belt by use of a different toner each time the image formation is effected. Further, it is preferable that the timing for forming the toner image directly on the conveying belt be set immediately after forming the image on the specified recording material in order not to cause the image deterioration when forming the image next time. Then, the timing of the toner image formation may be, as exemplified in the first embodiment discussed earlier, set just when the number of sheets of the specified transferring materials comes to a predetermined numerical amount.

Still further, a method for forming the toner image for cleaning on the photosensitive drum may involve forming a latent image having a desired a real size by the laser exposure and thereafter developing and forming the image by use of a desired developing device. Alternatively, there may be utilized the image forming method based on the analog developing system as explained in the first embodiment discussed earlier.

The toner zone forming operation explained above is conducted under the control of the control unit 40.

The image forming apparatus in the third embodiment is capable of removing the charge inhibition agent adhered on the conveying belt and performing the preferable image formation without adding any special means for cleaning by forming the toner image directly on the conveying belt as explained above.

(Fourth Embodiment)

Figure 13:
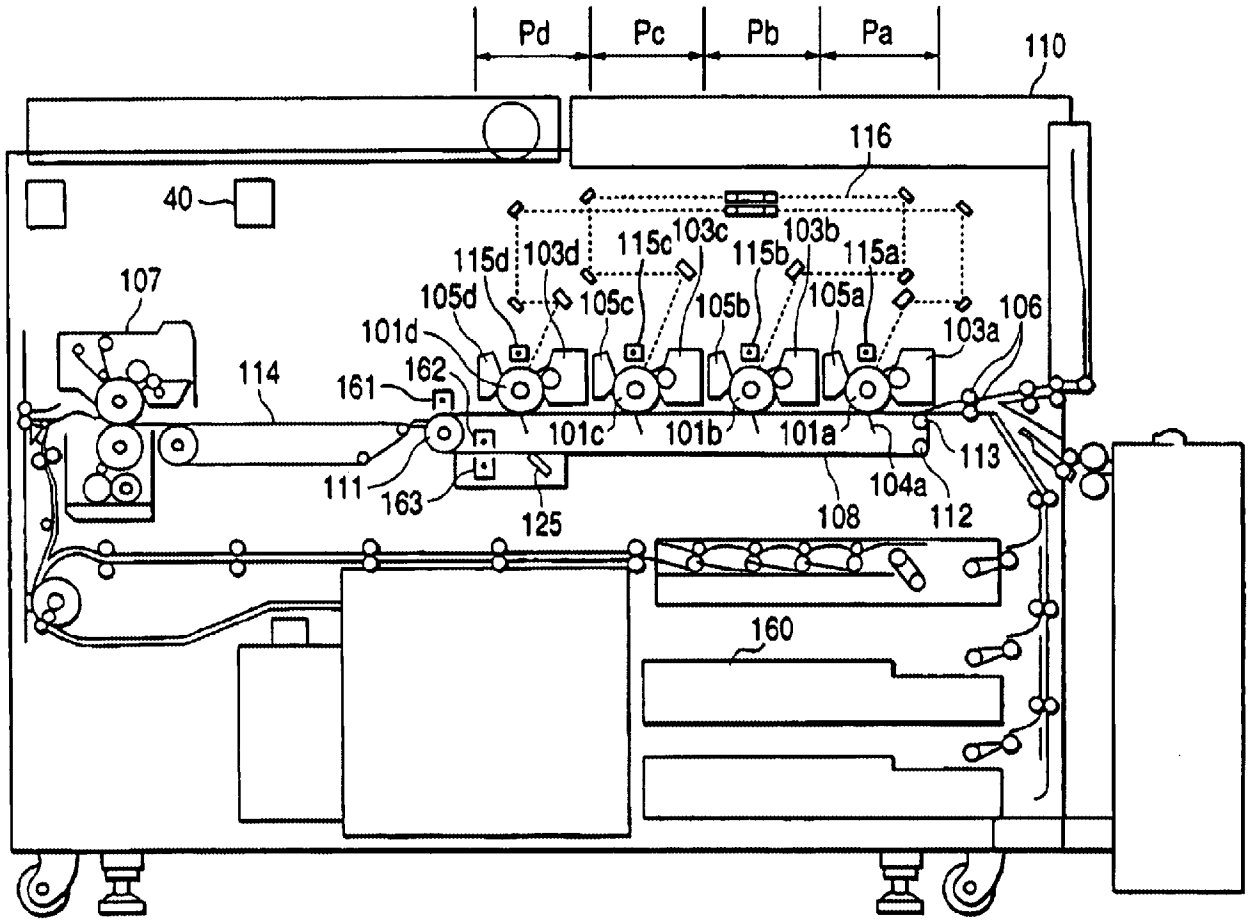
FIG. 13 is a schematic view of still another image forming apparatus of the present invention.

FIG. 13 is a diagram of the image forming apparatus, showing a fourth embodiment. What is characteristic of the fourth embodiment is a point that the cleaning unit for cleaning the conveying belt as a transferring material holding member uses a cleaning member (e.g., a cleaning blade) substantially fixed during the cleaning operation, and a point that the method for forming the toner image for cleaning on the photosensitive drum involves the use of method exemplified in the first embodiment discussed earlier. Configurations other than these points are the same as those in the third embodiment discussed earlier.

Referring to FIG. 13, the numeral 125 represents a cleaning blade constructed of, e.g., a urethane rubber, etc. The cleaning blade 125 abuts on the conveying belt 108, thus cleaning the belt surface.

Then, after executing the image formation by use of a specified transferring material, a desired toner zone image is formed on the photosensitive drum ad transferred onto the conveying belt 108, the toner image is supplied to the cleaning blade abut position, and a cleansing capability can be enhanced by utilizing a toner-based foreign matter removing effect.

The toner zone forming method may involve carrying out the method of forming the toner zone between the transferring materials in the embodiments 1 and 2 discussed earlier. For instance, in the case of the OHP sheet, the toner zone is formed for every 30 OHP sheets.

According to the fourth embodiment discussed above, the specified transferring material is passed by, whereby the foreign matter, even when adhered onto the conveying belt, can be removed effectively, thereby making it possible to prevent the occurrence of the image deterioration.

(Fifth Embodiment)

A characteristic of a fifth embodiment lies in forming the toner image on the conveying belt after the image formation only when the user performs an image formation on a transparent film (OHP). It is most effective that the toner image is formed on the conveying belt immediately after forming the image on the transparent film. Accordingly, if the toner image is formed on the conveying belt only in the case where the user performs the image formation on the transparent film, the consumption of the toners decreases, and this is more desirable to the user in terms of the cost.

An architecture for detecting the transparent film may be such that a detection apparatus constructed of a photo sensor, etc. including a light emitting device and a light receiving device, is installed in the middle of, e.g., a recording material conveying path, and the image forming apparatus body is notified of the light, as a medium detection signal, emitted from the light emitting device and penetrating a sheet-fed medium and received by the light receiving device, and may also be such that the user inputs a piece of recording material information from an input portion 180. When the image forming apparatus body recognizes by any one of the methods that the image is to be formed on the transparent film, the toner image may be formed on the conveying belt after the image formation thereof.

The image forming apparatus in the fifth embodiment constructed as described above forms the toner image on the conveying belt after the image formation only when forming the image on the transparent film (OHP), and is therefore capable of cleaning the charge inhibition agent on the transparent film, executing the preferable image formation and decreasing the amount of the toner consumption.

Note that the present invention has exemplified the charge inhibition agent applied over the transparent film (OHP) as a factor of the occurrence of the image deterioration. If the materials are those (such as glossy paper, special coating paper, etc.) bringing about the same harmful influence, the same effect can be obtained by applying the present invention thereto without being limited to the charge inhibition agent. In this case, the recording material detection portion is not limited to the transmissive type optical device, and a reflection type optical device, etc. can be considered.

Moreover, the embodiments discussed above have exemplified the mode in which the toner zone is formed in the case of the specified transferring material such as the OHP sheet, etc. but is not formed in the case of the transferring materials other than those given above. Also when forming the image on the normal transferring material, however, the toner zone is formed under the predetermined conditions (the formation frequency, etc.), and these toner zone forming conditions may be changed when forming the image on the specified transferring material such as the OHP sheet, etc. Namely, the toner zone formation frequency may be increased.

For example, when forming the image on the normal transferring material, the toner zone is formed for every 200 sheets for the purpose of ensuring the lubricating property of the cleaning blade, and so on. The toner zone is formed for every 30 sheets for the purpose of removing the charge inhibition agent in the case of the OHP sheet. In this way, the toner zone formation frequency is changed corresponding to the type of the transferring material.

What is claimed is:

1. An image forming apparatus comprising:

toner image forming means for forming a toner image on a first image bearing member;

first transferring means for transferring, onto a second image bearing member, the toner image formed on said first image bearing member;

second transferring means for transferring, onto a transferring material, the toner image formed on said second image bearing member;

cleaning means including a cleaning member abutting on a surface of said second image bearing member; and transferring material recognizing means for recognizing a type of the transferring material, wherein said toner image forming means forms a toner image for cleaning on said first image bearing member in accordance with information relating to a specific type of the transferring material that is recognized by said transferring material recognizing means, wherein said first transferring means transfers, onto said second image bearing member, the toner image for cleaning on said first image bearing member, and wherein said cleaning means collects the toner image for cleaning present on said second image bearing member.

2. An image forming apparatus according to claim 1, wherein an operation of forming the toner image for cleaning is conducted when the transferring material is of the specified type of the transferring material.

3. An image forming apparatus according to claim 2, further comprising number-of-passed-sheets counting means for counting a number of passed-sheets of the specified type of the transferring material, wherein when the number of passed-sheets counted by said number-of-passed-sheets counting means reaches a predetermined number of sheets, the operation of forming the toner image for cleaning is performed.

4. An image forming apparatus according to claim 3, wherein the information relating to the specified type of the transferring material is set according to a plurality of types of transferring materials, and wherein a predetermined number of sheets is set for each of the plurality of types of the transferring materials.

5. An image forming apparatus according to claim 2, wherein the specified type of the transferring material is a transferring material containing a charge inhibition agent.

6. An image forming apparatus according to claim 2, wherein the specified type of the transferring material is a transferring material containing a glue.

7. An image forming apparatus according to claim 1, wherein said transferring material recognizing means includes an optical sensor provided with at least a light emitting element and a light receiving element.

8. An image forming apparatus according to claim 1, wherein said transferring material recognizing means includes information input means capable of inputting the information relating to the specified type of the transferring material to said image forming apparatus.

9. An image forming apparatus according to claim 1, wherein said toner image forming means includes:

electrifying means for electrifying said first image bearing member at a desired potential by applying an electrifying bias;

exposing means for forming an electrostatic latent image by exposing a surface of said first image bearing member to light; and developing means for developing the electrostatic latent image with a toner by applying a developing bias, and wherein said first transferring means undergoes a transfer bias, thereby transferring the toner image.

10. An image forming apparatus according to claim 9, wherein a value of the developing bias is set to a same polarity as a value of the developing bias has when in a normal image formation and is set larger in its absolute value than an electrifying potential of said first image bearing member, thereby forming the toner image for cleaning present on said first image bearing member without causing said exposing means to operate.

11. An image forming apparatus according to claim 10, wherein a value of the transfer bias is set to a same polarity as a value of the transfer bias has when in the normal image formation and is set smaller in its absolute value than a value of the transfer bias when in the normal image formation, thereby transferring, onto said second image bearing member, the toner image for cleaning present on said first image bearing member.

12. An image forming apparatus comprising:

toner image forming means for forming a toner image on an image bearing member;

transferring material holding member for holding and conveying a transferring material towards said image bearing member;

transferring means for transferring, onto the transferring material, the toner image formed on said image bearing member;

cleaning means including a cleaning member abutting on a surface of said transferring material holding member; and transferring material recognizing means for recognizing a type of the transferring material, wherein said toner image forming means forms a toner image for cleaning on said image bearing member in accordance with information relating to a specified type of the transferring material that is recognized by said transferring material recognizing means, wherein said transferring means transfers, directly onto said transferring material holding member, the toner image for cleaning present on said image bearing member, and wherein said cleaning means collects the toner image for cleaning present on said transferring material holding member.

13. An image forming apparatus according to claim 12, wherein an operation of forming the toner image for cleaning is conducted when the transferring material comes is of a specified type of a transferring material.

14. An image forming apparatus according to claim 13, wherein the operation of forming the toner image for cleaning is conducted after finishing an image forming operation for the specified type of the transferring material.

15. An image forming apparatus according to claim 13, further comprising number-of-passed-sheets counting means for counting a number of passed-sheets of the specified type of the transferring material, wherein when the number of passed-sheets counted by said number-of-passed-sheets counting means reaches a predetermined number of sheets, the operation of forming the toner image for cleaning is performed.

16. An image forming apparatus according to claim 15, wherein the information relating to the specified type of the transferring material is set according to a plurality of types of transferring materials, and wherein a predetermined number of sheets is set for each of the plurality of types of the transferring materials.

17. An image forming apparatus according to claim 13, wherein the specified type of the transferring material is a transferring material containing a charge inhibition agent.

18. An image forming apparatus according to claim 13, wherein the toner image for cleaning is transferred onto an area in which the specified type of the transferring material is held on said transferring material holding member.

19. An image forming apparatus according to claim 12, wherein said transferring material recognizing means includes an optical sensor provided with at least a light emitting element and a light receiving element.

20. An image forming apparatus according to claim 12, wherein said transferring material recognizing means includes information input means capable of inputting the information relating to the specified type of the transferring material to said image forming apparatus.

21. An image forming apparatus according to claim 12, wherein said toner image forming means includes:

electrifying means for electrifying said image bearing member at a desired potential by applying an electrifying bias;

exposing means for forming an electrostatic latent image by exposing a surface of said image bearing member to light; and developing means for developing the electrostatic latent image with a toner by applying a developing bias, and wherein said transferring means undergoes a transfer bias, thereby transferring the toner image.

22. An image forming apparatus according to claim 21, wherein a value of the developing bias is set to a same polarity as a value of the developing bias has when in a normal image formation and is set larger in its absolute value than an electrifying potential of said image bearing member, thereby forming the toner image for cleaning present on said image bearing member without causing said exposing means to operate.

23. An image forming apparatus according to claim 22, wherein a value of the transfer bias is set to a same polarity as a value of the transfer bias has when in the normal image formation and is set smaller in its absolute value than a value of the transfer bias when in the normal image formation, thereby transferring, onto said transferring material holding member, the toner image for cleaning present on said image bearing member.

24. An image forming apparatus comprising:

toner image forming means for forming a toner image on a first image bearing member;

first transferring means for transferring, onto a second image bearing member, the toner image formed on said first image bearing member;

second transferring means for transferring, onto a transferring material, the toner image formed on said second image bearing member;

cleaning means including a cleaning member abutting on a surface of said second image bearing member;

transferring material recognizing means for recognizing a type of the transferring material; and control means for controlling said image forming apparatus so that said cleaning means collects a toner image for cleaning that is transferred onto said second image bearing member after being formed on said first image bearing member, wherein said control means changes a condition for forming the toner image for cleaning in accordance with information relating to a specified type of the transferring material that is recognized by said transferring material recognizing means.

25. An image forming apparatus according to claim 24, wherein the toner image for cleaning is formed each time a number of passed sheets of the transferring material reaches a predetermined number of sheets, and wherein the condition for forming the toner image for cleaning is the predetermined number of sheets.

26. An image forming apparatus according to claim 25, wherein a value of the predetermined number of sheets in a case of the specified type of the transferring material is larger than a value of the predetermined number of sheets in a case of a transferring material other than the specified type of the transferring material.

27. An image forming apparatus according to claim 26, wherein the specified type of the transferring material is a transferring material containing a charge inhibition agent.

28. An image forming apparatus according to claim 26, wherein the specified type of the transferring material is a transferring material containing a glue.

29. An image forming apparatus according to claim 24, wherein said toner image forming means includes:

electrifying means for electrifying said first image bearing member at a desired potential by applying an electrifying bias;

exposing means for forming an electrostatic latent image by exposing a surface of said first image bearing member to light; and developing means for developing the electrostatic latent image with a toner by applying a developing bias, and wherein said first transferring means undergoes a transfer bias, thereby transferring the toner image.

30. An image forming apparatus according to claim 29, wherein a value of the developing bias is set to a same polarity as a value of the developing bias has when in a normal image formation and is set larger in its absolute value than an electrifying potential of said first image bearing member, thereby forming the toner image for cleaning present on said first image bearing member without causing said exposing means to operate.

31. An image forming apparatus according to claim 30, wherein a value of the transfer bias is set to a same polarity as a value of the transfer bias has when in the normal image formation and is set smaller in its absolute value than a value of the transfer bias when in the normal image formation, thereby transferring, onto said second image bearing member, the toner image for cleaning present on said first image bearing member.

32. An image forming apparatus comprising:

toner image forming means for forming a toner image on an image bearing member;

transferring material holding member for holding and conveying a transferring material towards said image bearing member;

transferring means for transferring, onto the transferring material, the toner image formed on said image bearing member;

cleaning means including a cleaning member abutting on a surface of said transferring material holding member;

transferring material recognizing means for recognizing a type of the transferring material; and control means for controlling said image forming apparatus so that said cleaning means collects a toner image for cleaning that is transferred directly onto said transferring material holding member after being formed on said image bearing member, wherein said control means changes a condition for forming the toner image for cleaning in accordance with information relating to a specified type of the transferring material that is recognized by said transferring material recognizing means.

33. An image forming apparatus according to claim 32, wherein the toner image for cleaning is formed each time a number of passed sheets of the transferring material reaches a predetermined number of sheets, and wherein the condition for forming the toner image for cleaning is the predetermined number of sheets.

34. An image forming apparatus according to claim 33, wherein a value of the predetermined number of sheets in a case of the specified type of the transferring material is larger than a value of the predetermined number of sheets in a case of a transferring material other than the specified type of the transferring material.

35. An image forming apparatus according to claim 34, wherein the specified type of the transferring material is a transferring material containing a charge inhibition agent.

36. An image forming apparatus according to claim 34, wherein the specified type of the transferring material is a transferring material containing a glue.

37. An image forming apparatus according to claim 32, wherein said toner image forming means includes:

electrifying means for electrifying said image bearing member at a desired potential by applying an electrifying bias;

exposing means for forming an electrostatic latent image by exposing a surface of said image bearing member to light; and developing means for developing the electrostatic latent image with a toner by applying a developing bias, and wherein said transferring means undergoes a transfer bias, thereby transferring the toner image.

38. An image forming apparatus according to claim 37, wherein a value of the developing bias is set to a same polarity as a value of the developing bias has when in a normal image formation and set larger in its absolute value than an electrifying potential of said image bearing member, thereby forming the toner image for cleaning present on said image bearing member without causing said exposing means to operate.

39. An image forming apparatus according to claim 38, wherein a value of the transfer bias is set to a same polarity as a value of the transfer bias has when in the normal image formation and set smaller in its absolute value than a value of the transfer bias when in the normal image formation, thereby transferring, onto said transferring material holding member, the toner image for cleaning present on said image bearing member.

* * * * *

UNITED STATES PATENT AND TRADEMARK OFFICE

CERTIFICATE OF CORRECTION

PATENT NO. : 6,856,772 B2
DATED : February 15, 2005
INVENTOR(S) : Yuji Bessho et al.

It is certified that error appears in the above-identified patent and that said Letters Patent is hereby corrected as shown below:

Drawings,
SHEET 1, FIGURE 1, “31TH” should read -- 31ST --; and “32TH” should read -- 32ND --.

Column 3,
Line 6, “envelop,” should read -- envelope, --;
Line 23, “envelop.” should read -- envelope. --; and
Line 61, “over directly” should read -- directly over --.

Column 4,
Line 5, “envelop,” should read -- envelope, --; and
Lines 8, 12 and 14, “envelop” should read -- envelope --.

Column 8,
Line 13, “($1\times10^{10}\Omega$cm).” should read -- ($1\times10^{10}\Omega\cdot$cm). --.

Column 11,
Line 30, “receives” should read -- receive --.

Column 13,
Lines 57 and 63, “envelop” should read -- envelope --.

Column 14,
Line 17, “fifth” should read -- fifty --;
Line 26, “portion 3” should read -- portion 30 --;
Line 29, “which” should read -- which is --; and
Lines 33 and 41, “envelop,” should read -- envelope, --.

Column 15,
Line 23, “a” should be deleted;
Line 24, “electrifiers” should read -- Electrifiers --; and
Line 32, “etc..” should read -- etc. --.

Column 16,
Line 4, “on to” should read -- onto --.

UNITED STATES PATENT AND TRADEMARK OFFICE

CERTIFICATE OF CORRECTION

PATENT NO. : 6,856,772 B2
DATED : February 15, 2005
INVENTOR(S) : Yuji Bessho et al.

It is certified that error appears in the above-identified patent and that said Letters Patent is hereby corrected as shown below:

Column 18,
Line 17, "recognizes" should read -- recognized --.

Signed and Sealed this

Twenty-ninth Day of November, 2005

JON W. DUDAS
*Director of the United States Patent and Trademark Office*